US009440762B2

(12) United States Patent
Kagawa et al.

(10) Patent No.: US 9,440,762 B2
(45) Date of Patent: Sep. 13, 2016

(54) WRAP AROUND CASE

(71) Applicant: FUJIFILM CORPORATION, Minato-ku, Tokyo (JP)

(72) Inventors: Yusuke Kagawa, Kanagawa (JP); Nobuyuki Kimoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/940,150

(22) Filed: Nov. 13, 2015

(65) Prior Publication Data

US 2016/0144996 A1 May 26, 2016

(30) Foreign Application Priority Data

Nov. 25, 2014 (JP) ..... 2014-238208

(51) Int. Cl.

| | |
|---|---|
| ***B65D 5/54*** | (2006.01) |
| ***B65D 5/02*** | (2006.01) |
| ***B65D 85/38*** | (2006.01) |
| ***B65D 5/42*** | (2006.01) |

(52) U.S. Cl.

CPC ..... *B65D 5/0254* (2013.01); *B65D 5/4266* (2013.01); *B65D 5/542* (2013.01); *B65D 5/5425* (2013.01); *B65D 85/38* (2013.01)

(58) Field of Classification Search

CPC .. B65D 5/0254; B65D 5/542; B65D 5/5425; B65D 5/545; B65D 5/5455; B65D 5/4266

USPC ..... 229/224, 225, 226, 237, 160.2, 228

See application file for complete search history.

(56) References Cited

U.S. PATENT DOCUMENTS

| | | | | |
|---|---|---|---|---|
| 2,737,095 | A * | 3/1956 | Simjian | G03B 17/53 221/199 |
| 4,915,235 | A * | 4/1990 | Roosa | A47G 21/001 229/121 |
| 4,919,785 | A * | 4/1990 | Willey | B65D 5/5455 229/188 |
| 5,167,606 | A * | 12/1992 | Kuchenbecker | B65D 5/06 493/160 |
| 6,273,329 | B1 * | 8/2001 | Zavatone | B65D 5/6667 229/102 |
| 6,394,340 | B1 * | 5/2002 | Anchor | B65D 5/542 229/207 |
| 6,761,269 | B2 * | 7/2004 | Hamming | B65D 83/0805 206/777 |
| 7,988,034 | B2 * | 8/2011 | Pezzoli | B65D 5/541 229/121 |
| 2006/0032900 | A1 * | 2/2006 | Pratt | B31B 1/62 229/135 |
| 2011/0024487 | A1 * | 2/2011 | Sant'Ana Caceres | B65D 5/2057 229/232 |
| 2015/0197383 | A1 * | 7/2015 | Wilson | B31B 1/14 229/242 |

FOREIGN PATENT DOCUMENTS

| | | |
|---|---|---|
| JP | 2004-59073 A | 2/2004 |
| JP | 3176475 U | 6/2012 |

* cited by examiner

*Primary Examiner* — Gary Elkins

(74) *Attorney, Agent, or Firm* — Solaris Intellectual Property Group, PLLC

(57) ABSTRACT

A wrap around case including: a case body that includes a top face panel and a bottom face panel, a front face panel and a back face panel, and a pair of side face panels, and that is formed with a perforated tear section running along a ridgeline formed by the top face panel and each of the pair of side face panels; and an overlap section that extends from the top face panel toward the bottom face panel side and overlaps the front face panel, and that is formed with a gap to an edge portion at the bottom face panel side of a cutout portion formed at a position offset to one end side or another end side of the center, along the facing direction of the side face panels, of an edge portion at the top face panel side of the front face panel.

8 Claims, 10 Drawing Sheets

WRAP AROUND CASE

CROSS-REFERENCE TO RELATED APPLICATION

This application is based on and claims priority under 35 USC 119 from Japanese Patent Application No. 2014-238208 filed on Nov. 25, 2014, the disclosure of which is incorporated by reference herein.

BACKGROUND

1. Technical Field

The present invention relates to a wrap around case.

2. Related Art

As a wrap around case (wrap-round case) for storing products for transportation, etc. Japanese Utility Model Registration No. 3176475 describes a cardboard box in which a top face panel and a bottom face panel that face each other, and a pair of side walls (side face panels) that face each other, are provided continuously to each other. Note that in the cardboard box described in Japanese Utility Model Registration No. 3176475, a first tear guide line (a perforated tear section) is formed contiguously to the top face panel and an upper side outer flap extending from the top face panel toward the bottom face panel side in a sealed state. The cardboard box is configured so as to be capable of being opened by detaching the top face panel and the upper side outer flap along the first tear guide line. A semicircular shaped cutout portion, for a hand to hook onto the upper side outer flap, is formed at the center of an end edge of a lower side outer flap that abuts the upper side outer flap from below. Japanese Patent Application Laid-Open (JP-A) No. 2004-59073 describes a wrap around case including a belt shaped cut-off section.

Since the wrap around case of Japanese Utility Model Registration No. 3176475 is configured such that opening is performed by tearing the perforation, the structure is such that the top face panel is not easily opened, even if the case is dropped. However, when the upper side outer flap is hooked and pulled upward by hand, load is evenly distributed to the tear sections at either side, such that there is room for improvement from the perspective of improving ease of opening. In wrap around cases including a belt shaped cut-off section such as that described in JPA-No. 2004-59073, opening can be performed simply by gripping and pulling one end portion of the cut-off section; however, since the cut-off section is detached, repackaging cannot be performed after opening.

SUMMARY

In consideration of the above circumstances, an object of the present invention is to obtain a wrap around case capable of improving ease of opening, while securing fall resistant ability and repackaging ability.

In order to resolve the above issues, a wrap around case according to the present invention includes: a case body that includes a top face panel and a bottom face panel facing each other, a front face panel and a back face panel facing each other, and a pair of side face panels facing each other, and that is formed with a perforated tear section running along a ridgeline formed by the top face panel and each of the pair of side face panels; and an overlap section that extends from the top face panel toward the bottom face panel side and overlaps the front face panel, and that is formed with a gap to an edge portion at the bottom face panel side of a cutout portion formed at a position offset to one end side or another end side of the center, along the facing direction of the side face panels, of an edge portion at the top face panel side of the front face panel.

The present invention can improve ease of opening, while securing fall resistant ability and repackaging ability.

BRIEF DESCRIPTION OF THE DRAWINGS

Exemplary embodiments of the present invention will be described in detail based on the following figures, wherein.

DETAILED DESCRIPTION

Explanation follows regarding exemplary embodiments according to the present invention, based on the drawings. Note that in each of the drawings, the arrow L indicates a depth direction from a back face side toward a front face side when a wrap around case in a sealed state is placed on a horizontal plane, the arrow W indicates the width direction from the right side toward the left side when the wrap around case is viewed from the front face, and the arrow UP indicates the up-down direction from a bottom face side toward a top face side.

First Exemplary Embodiment

Figure 1:
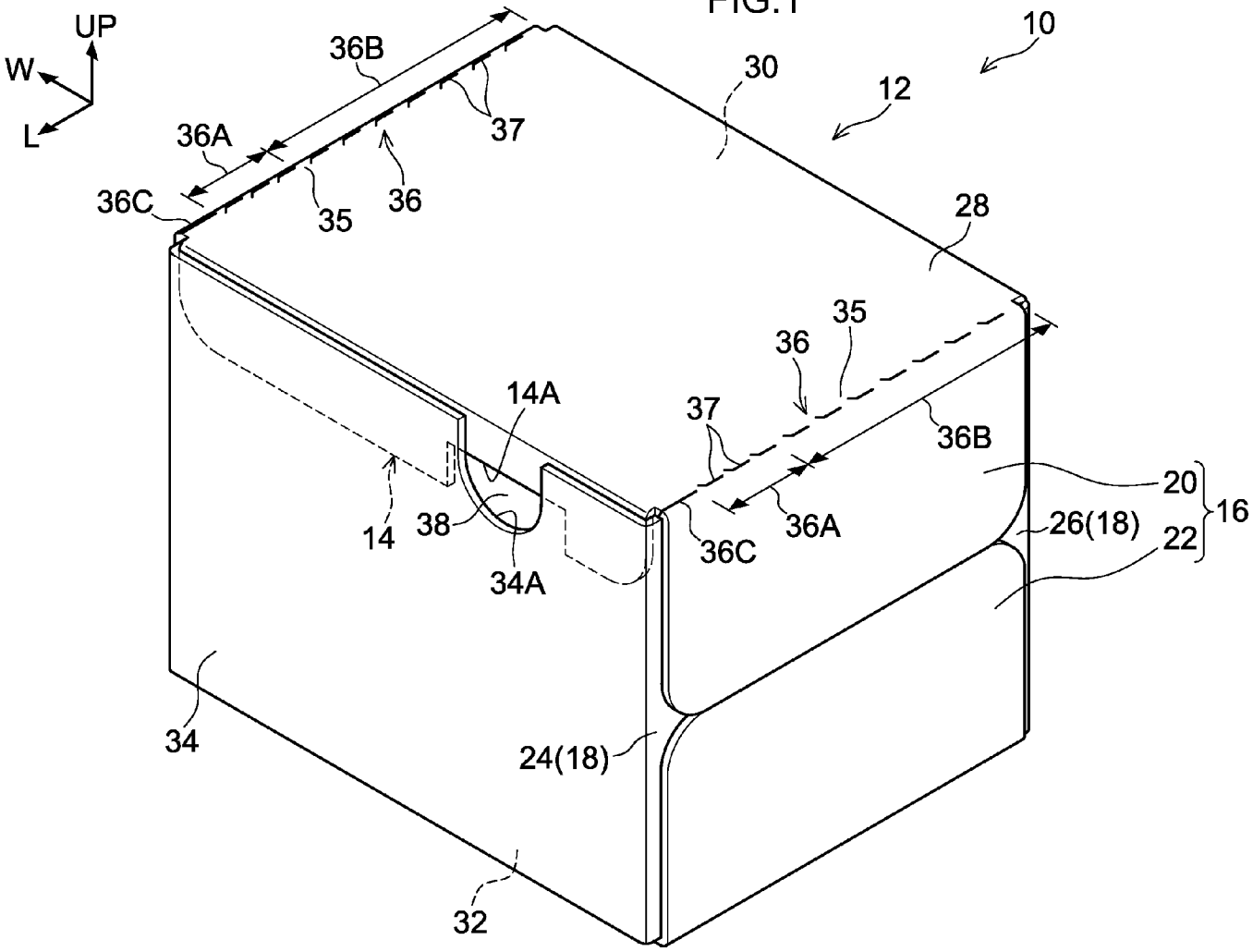
FIG. 1 is a perspective view of a front face side of a wrap around case according to a first exemplary embodiment, viewed diagonally from above.
Figure 4:
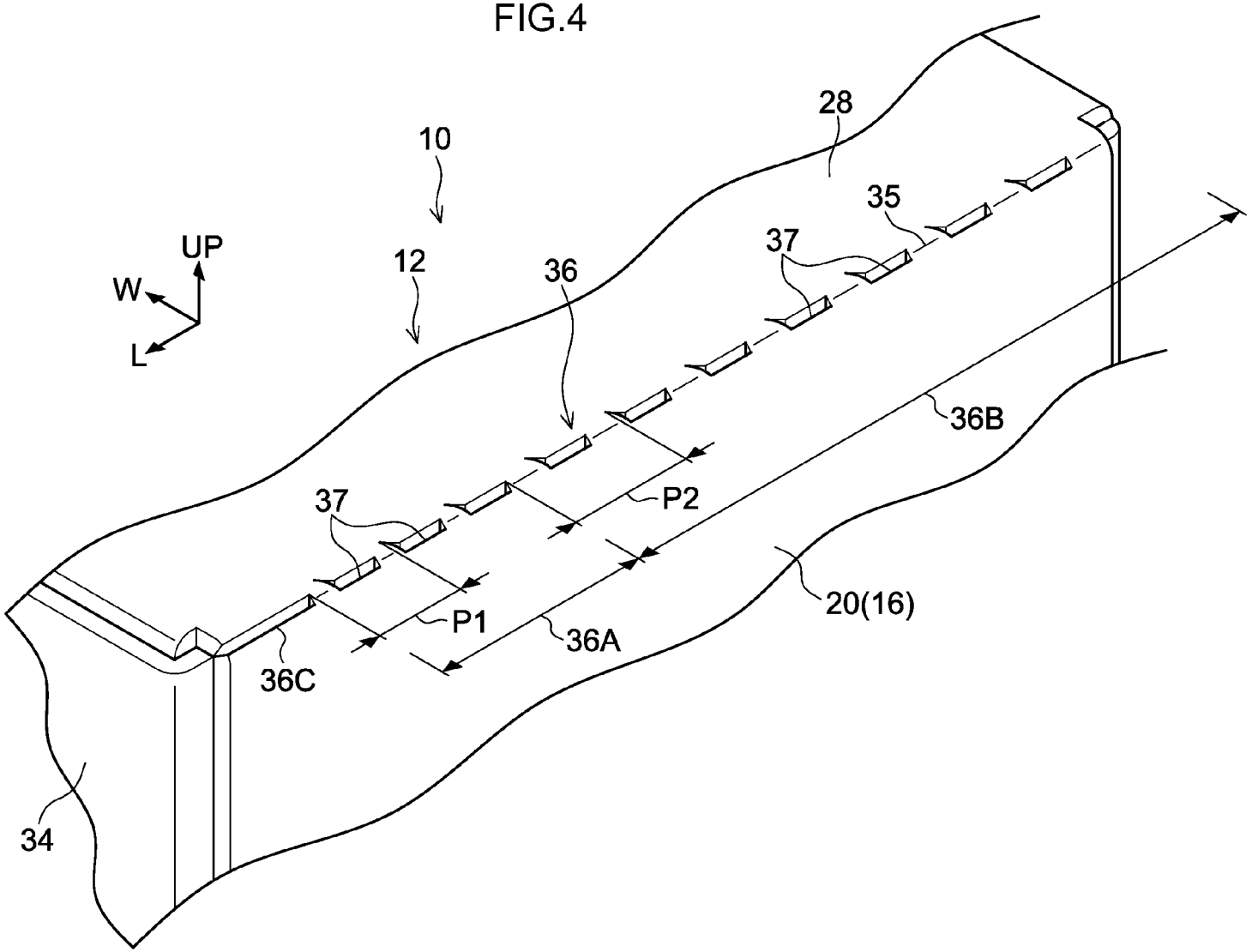
FIG. 4 is an enlarged perspective view illustrating relevant portions of a ridgeline between a top face panel and a side face panel of a wrap around case according to the first exemplary embodiment.
Figure 5:
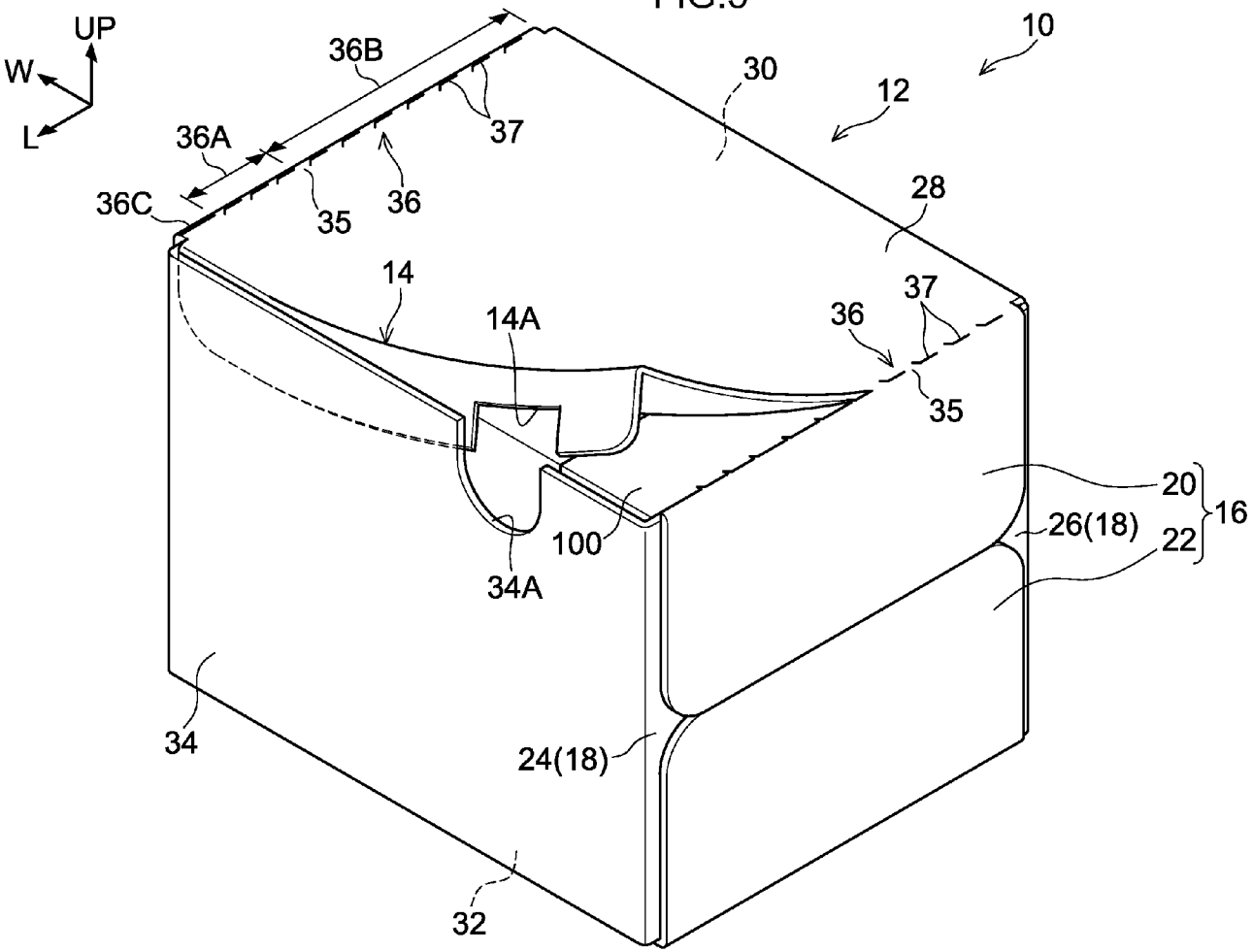
FIG. 5 is a perspective view corresponding to FIG. 1, illustrating a state in which a wrap around case according to the first exemplary embodiment is being opened, with an operator omitted from illustration.
Figure 6:
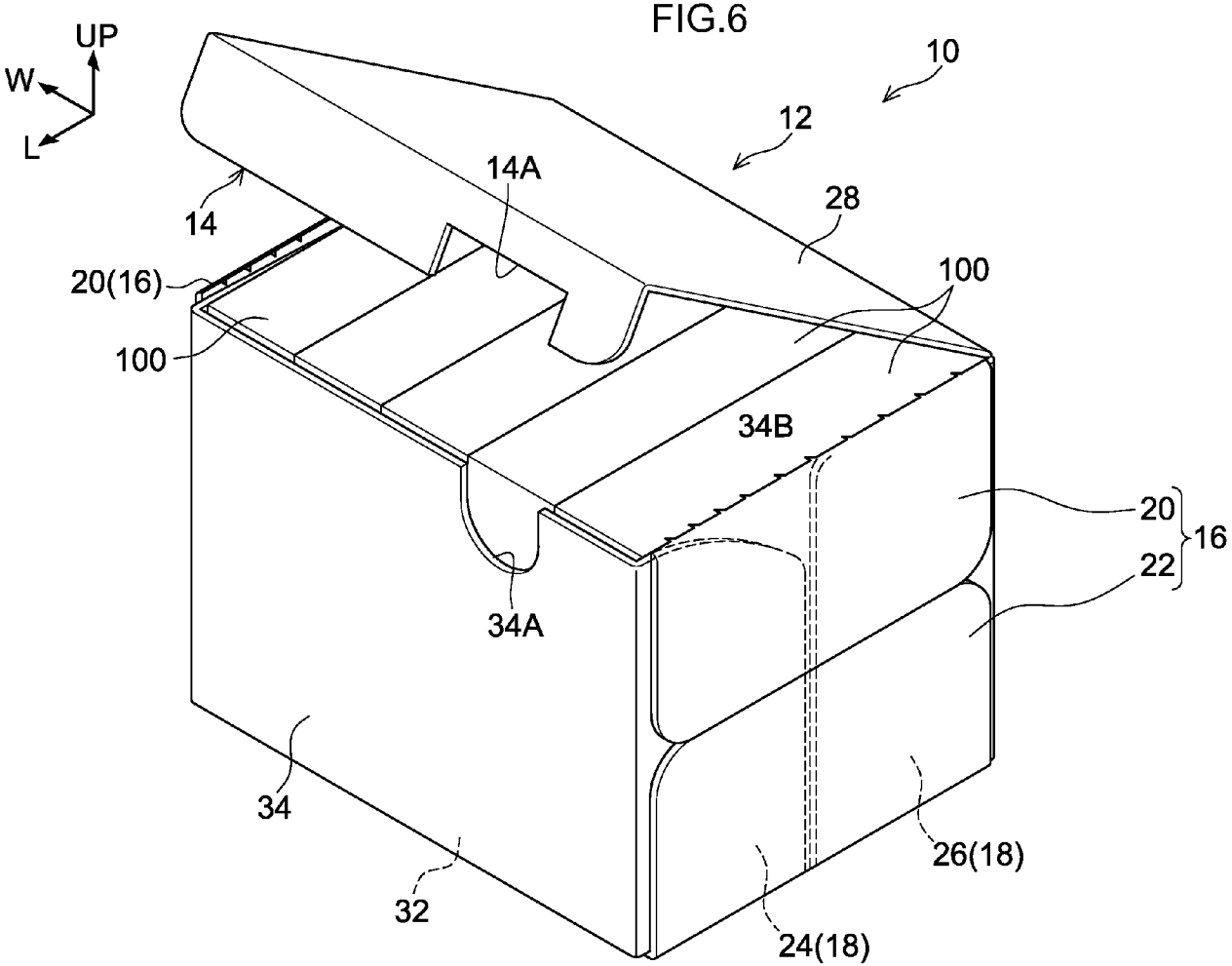
FIG. 6 is a perspective view corresponding to FIG. 1, illustrating a state in which a wrap around case according to the first exemplary embodiment has been opened.

Explanation follows regarding a wrap around case (wrap-round case) according to a first exemplary embodiment of the present invention, based on FIG. 1 to FIG. 6. As illustrated in FIG. 1, in the sealed state (an assembled state storing a product), a wrap around case 10 of the present exemplary embodiment includes a substantially box-shaped case body 12. Note that in the present exemplary embodiment as an example, a paper or plastic cardboard sheet with an even thickness is employed to form the wrap around case 10. As illustrated in FIG. 6, the wrap around case 10 of the present exemplary embodiment stores plural recording tape cartridges 100. Specifically, the wrap around case 10 is formed with a size that is capable of storing five recording tape cartridges 100. Note that each recording tape cartridge 100 is configured such that a recording tape such as a magnetic tape is wound onto a single reel and stored inside a flattened rectangular box shaped case. The respective recording tape cartridges 100 overlap each other in a state stored in a flattened rectangular box shaped container, and are stored inside the wrap around case 10 without any gaps. Note that the present invention is not limited thereto, and may be formed of a size capable of storing six or more recording tape cartridges 100, or may be formed of a size capable of storing four or less recording tape cartridges 100. Moreover, the present invention may be employed as a case for storing a product other than recording tape cartridges.

Overall Configuration

Figure 2:
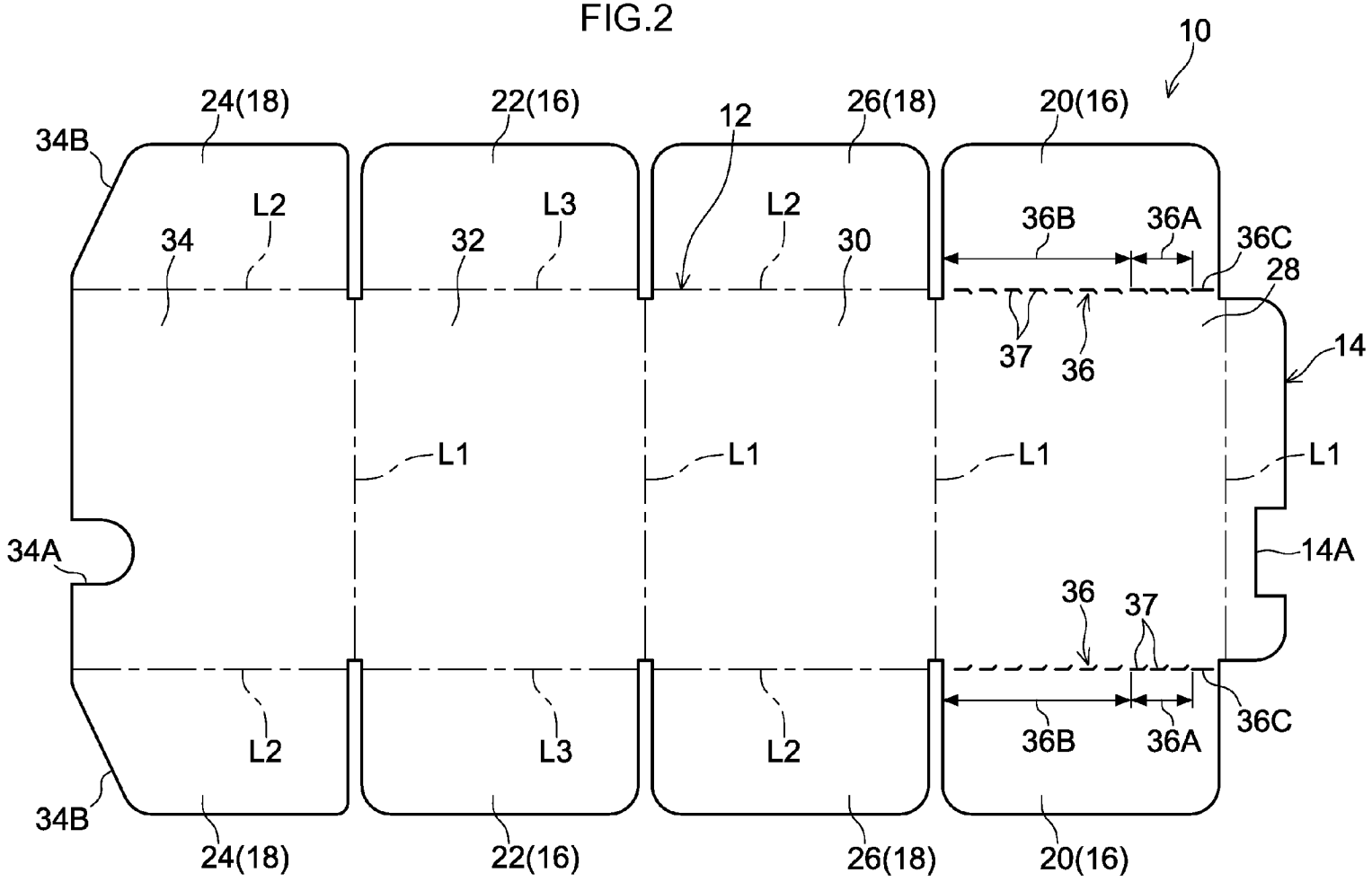
FIG. 2 is an opened-out view of a wrap around case according to the first exemplary embodiment.

As illustrated in FIG. 1 and FIG. 2, the case body 12 is mainly configured including a top face panel 28, a back face panel 30, a bottom face panel 32, a front face panel 34, and a pair of side face panels 16. As illustrated in FIG. 2, in the present exemplary embodiment, the top face panel 28, the back face panel 30, the bottom face panel 32, and the front face panel 34 are provided continuously to each other. The top face panel 28, the back face panel 30, the bottom face panel 32, and the front face panel 34 are each formed in a substantially rectangular shape in plan view of an opened-out state. A cutout portion 34A is formed to the front face panel 34. Details of the cutout portion 34A are explained later.

As illustrated by single-dotted dashed lines in FIG. 2, fold lines L1 are respectively set between the top face panel 28 and the back face panel 30, between the back face panel 30 and the bottom face panel 32, and between the bottom face panel 32 and the front face panel 34. A fold line L1 is also set between the top face panel 28 and an overlap section 14, described later. Note that the fold lines L1 may be configured by fold-line forming in order to facilitate folding. Similar applies to fold lines L2 and fold lines L3, described later.

As illustrated in FIG. 1, in the sealed state, the top face panel 28 and the bottom face panel 32 face each other along the up-down direction. The front face panel 34 and the back face panel 30 face each other along the depth direction. The pair of side face panels 16 face each other along the width direction.

Note that each side face panel 16 is configured including an upper side outer flap 20 disposed at an upper portion, and a lower side outer flap 22 disposed at a lower portion, and an inner panel 18 is provided at the width direction inside of each side face panel 16. In the present exemplary embodiment, the upper side outer flap 20 and the lower side outer flap 22 abut each other vertically. Note that a gap may be provided between the upper side outer flap 20 and the lower side outer flap 22.

As illustrated in FIG. 2, each of a pair of the upper side outer flaps 20 is provided at either width direction side of the top face panel 28. Each upper side outer flap 20 is formed in a substantially rectangular shape with rounded corner portions at a leading end side thereof. A perforated tear section 36 is formed between each of the pair of upper side outer flaps 20 and the top face panel 28. The tear section 36 is formed running along a ridgeline 35 formed by the top face panel 28 and the side face panel 16 in a folded state of the upper side outer flap 20 (see FIG. 1). Details of the tear section 36 are explained later.

Each of a pair of the lower side outer flaps 22 is provided at either width direction side of the bottom face panel 32. Each lower side outer flap 22 is formed in a substantially rectangular shape with rounded corner portions at a leading end side thereof. Configuration is such that the fold line L3 is formed between each of the pair of lower side outer flaps 22 and the bottom face panel 32, and the lower side outer flap 22 is folded along the fold line L3.

Each of a pair of back face side inner flaps 26 configuring a back face side of the inner panel 18 is provided at either width direction side of the back face panel 30. Each of the pair of back face side inner flaps 26 is formed in a substantially rectangular shape with rounded corner portions at a leading end side thereof. Configuration is such that the fold line L2 is formed between each of the pair of back face side inner flaps 26 and the back face panel 30, and the back face side inner flap 26 is folded along the fold line L2.

Each of a pair of front face side inner flaps 24 configuring a front face side of the inner panel 18 is provided at either width direction side of the front face panel 34. Each of the pair of front face side inner flaps 24 is formed in a substantially trapezoid shape with rounded corner portions at a leading end side thereof. Specifically, an edge at the bottom face panel 32 side (the lower side in the sealed state) of the front face side inner flap 24 extends along the width direction, whereas an edge at the opposite side (the upper side in the sealed state) configures a sloped portion 34B that slopes toward the bottom face panel 32 side on progression from the front face panel 34 toward the leading end side thereof. Configuration is such that the fold line L2 is formed between each of the pair of front face side inner flaps 24 and the front face panel 34, and the front face side inner flap 24 is folded along the fold line L2.

As illustrated in FIG. 1, in the sealed state, the back face side inner flaps 26 and the front face side inner flaps 24 are folded along the fold lines L2 further toward the width direction inside than the upper side outer flaps 20 and the lower side outer flaps 22. The back face side inner flaps 26 and the front face side inner flaps 24 extend out in a direction facing each other from either end edge of the back face panel 30 and either end edge of the front face panel 34. Note that a gap may be provided between each back face side inner flap 26 and the front face side inner flap 24.

The upper side outer flaps 20 and the lower side outer flaps 22 are folded along the tear sections 36 and the fold lines L3, and extend out in a direction facing each other from either end edge of the top face panel 28 and either end edge of the bottom face panel 32. Specifically, each upper side outer flap 20 extends downward from either width direction end edge of the top face panel 28, and each lower side outer flap 22 extends upward from either width direction end edge of the bottom face panel 32. The upper side outer flap 20 and the lower side outer flap 22 are adhered by adhesive or the like to the respective back face side inner flap 26 and the front face side inner flap 24, thereby configuring the side face panel 16. Note that, although only the side face panel 16 at the left side is illustrated in FIG. 1, the side face panel 16 at the left side is also similarly configured (see FIG. 3).

Overlap Section and Cutout Portion

Explanation follows regarding the overlap section 14 that is continuously provided to the top face panel 28, and the cutout portion 34A formed to the front face panel 34. As illustrated in FIG. 2, the overlap section 14 is continuously provided to an end portion of the top face panel 28 at the opposite side to the back face panel 30. The overlap section 14 is formed in a long, thin, substantially rectangular shape with rounded corner portions at a leading end side in plan view of the opened-out state. Configuration is such that the fold line L1 is formed between the overlap section 14 and the top face panel 28, and the overlap section 14 is folded along the fold line L1.

As illustrated in FIG. 1, in the sealed state, the overlap section 14 is folded along the fold line L1, and extends downward from an end edge of the top face panel 28 at the front face panel 34 side toward the bottom face panel 32. In the present exemplary embodiment, the overlap section 14 overlaps a face at the inside (the back face panel 30 side) of the front face panel 34, and the top face panel 28 and the front face panel 34 are combined by the overlap section 14.

The width direction length of the overlap section 14 is formed to be substantially the same length as the top face panel 28, and the up-down direction length (height) of the overlap section 14 in the sealed state is formed shorter than half the up-down direction length of the front face panel 34. Note that there is no particular limitation to the up-down direction length of the overlap section 14, as long as the length does not impair ease of insertion inside the front face panel 34 during sealing, while securing a length that does not easily come out from inside the front face panel 34.

Figure 3:
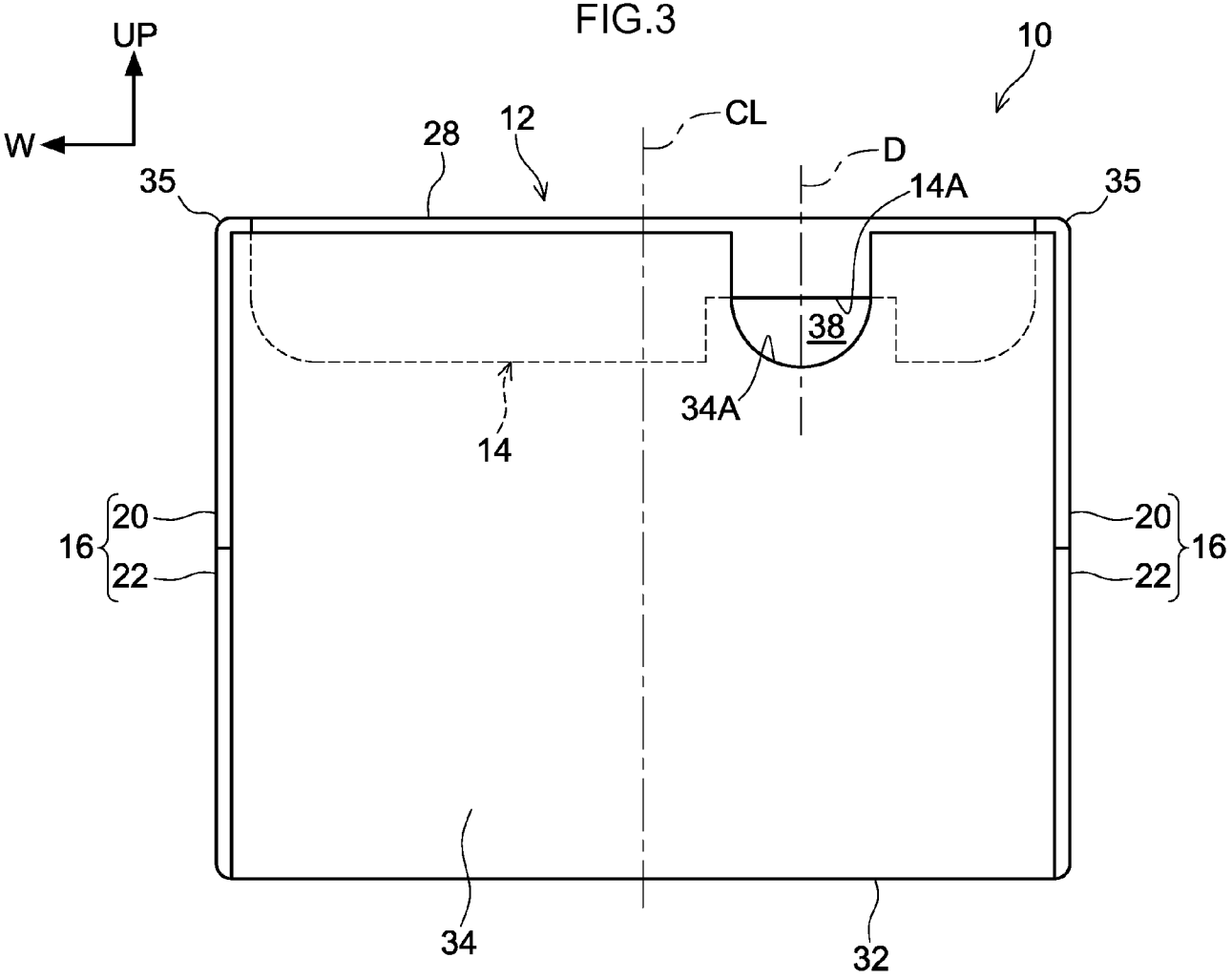
FIG. 3 is a front face view of a wrap around case according to the first exemplary embodiment.

Note that an end edge at the leading end side of the overlap section 14 is cut out to form a short-height portion 14A. As illustrated in FIG. 3, the short-height portion 14A is formed with a shorter up-down direction length (height) than other portions (a general portion) of the overlap section 14. The short-height portion 14A is formed at a portion that is exposed through the cutout portion 34A, described below, in front face view, and in the present exemplary embodiment, is formed in a shape with a portion at a lower end (leading end) side cut out in a substantially rectangular shape. The width direction length of the short-height portion 14A is formed slightly longer than the width of the cutout portion 34A.

The cutout portion 34A is formed to an upper edge portion (an edge portion at the top face panel 28 side) of the front face panel 34. An edge portion of the cutout portion 34A is shaped in a substantially U-shape that opens upward in front face view. Namely, a lower edge portion (an edge portion at the bottom face panel 32 side) of the cutout portion 34A is formed in a substantially circular arc shape.

Note that the cutout portion 34A is formed at a position offset to the right side of a center line CL (center) along the width direction (the facing direction of the side face panels 16) of the front face panel 34. The cutout portion 34A is formed extending further downward than a lower end portion of the short-height portion 14A formed to the overlap section 14. A gap 38 is thereby formed between the cutout portion 34A and the short-height portion 14A (overlap section 14). Note that, "formed at a position offset" referred to herein is a concept including configurations in which the width direction center of the cutout portion 34A is formed at a position offset to the right side (one end side) or the left side (another end side) of the width direction center of the front face panel 34. Namely, as long as a center line D in the width direction of the cutout portion 34A is offset to the right side or the left side of the center line CL in the width direction of the front face panel 34, the cutout portion 34A may be formed at a position that straddles the center line CL.

Tear Section

Explanation follows regarding the perforated tear section 36 formed between each upper side outer flap 20 and the top face panel 28. As illustrated in FIG. 1, in the sealed state, the perforated tear section 36 is formed along the ridgeline 35 between the top face panel 28 and each side face panel 16. Specifically, the tear section 36 is configured by incision portions 37 arrayed in the depth direction along the ridgeline 35 between the top face panel 28 and the side face panel 16. Each incision portion 37 is formed in a substantially L-shape, including a portion extending in a straight line along the ridgeline 35, and a portion extending out toward the front face side and the width direction inside. Note that the front face panel 34 side of the tear section 36 configures a narrow pitch portion 36A, and the back face panel 30 side of the tear section 36 configures a wide pitch portion 36B.

As illustrated in FIG. 4, an interval (pitch) P1 of each incision portion 37 of the narrow pitch portion 36A at the front face panel 34 side of the tear section 36 is formed narrower than an interval (pitch) P2 of each incision portion 37 of the wide pitch portion 36B at the back face panel 30 side, and is approximately half the interval in the present exemplary embodiment. An end portion incision portion 36C, which is incised contiguous to end portions at the front face side of the top face panel 28 and the side face panel 16, is formed further to the front face panel 34 side than the narrow pitch portion 36A. Note that in the present exemplary embodiment, the narrow pitch portion 36A is configured from an end portion at the back face side of the end portion incision portion 36C as far as the third incision portion 37, and the wide pitch portion 36B is configured further to the back face side than the narrow pitch portion 36A.

Operation and Advantageous Effects

Explanation follows regarding operation and advantageous effects of the present exemplary embodiment.

As illustrated in FIG. 1, in the wrap around case 10 of the present exemplary embodiment, in the sealed state, the top face panel 28 and the upper side outer flaps 20 (side face panels 16) are linked together by the perforated tear sections 36. Thus, even if the wrap around case 10 is dropped, the top face panel 28 can be suppressed from opening due to the impact of being dropped. Namely, this enables drop resistant ability to be better secured than in structures in which the top face panel 28 and the side face panels 16 are not linked together.

The wrap around case 10 of the present exemplary embodiment can be easily opened by hooking a hand onto the short-height portion 14A of the overlap section 14 and pulling upward. Explanation follows regarding these operation and advantageous effects with respect to an operating procedure during opening. Note that, although the below explanation refers to a case in which the opening is performed by an operator, configuration is not limited thereto, and similar applies to cases in which the opening is performed using a machine or another tool.

When opening the wrap around case 10 that is in the sealed state, the operator hooks their hand on the short-height portion 14A of the overlap section 14 and pulls the top face panel 28 upward, thereby tearing the tear sections 36. As illustrated in FIG. 3, when this is performed, since the gap 38 for hooking the hand is formed between the overlap section 14 and the cutout portion 34A, the operator can insert their hand into the gap 38 and pull the overlap section 14 upward. Namely, ease of operation while opening can be improved compared to configurations in which the gap 38 is not formed.

As illustrated in FIG. 4, the end portion incision portion 36C is formed at the front face side of each tear section 36. This enables the portion of the top face panel 28 where the end portion incision portion 36C is formed to be lifted up when the overlap section 14 is pulled upward. Opening is thereby easier than in configurations in which the end portion incision portions 36C are connected.

As illustrated in FIG. 3, the cutout portion 34A is formed at a position offset to the right side of the center line CL (center) of the front face panel 34. Thus, out of load acting on the tear sections 36 at both sides when the top face panel 28 is pulled upward, a larger load acts on the tear section 36 at the right side. As illustrated in FIG. 5, by concentrating load on the tear section 36 at the right side in this manner, the tear section 36 at the right side is first to tear, and a portion at the right side of the top face panel 28 starts to open. Moreover, since the front face panel 34 side of the tear section 36 is formed with the narrow pitch portion 36A, the strength is weaker than the wide pitch portion 36B at the back face panel 30 side. This enables the load required for opening to be reduced.

The top face panel 28 is lifted up due to the right side being opened, and the tear section 36 at the left side also starts to tear accompanying this. At this point, a portion of the top face panel 28 has been pulled upward, thereby enabling the tear section 36 to be torn under a small load. Such an opening configuration, in which load is concentrated to tear the right side (one) tear section 36, and the left side (another) tear section 36 is then torn, enables ease of opening to be improved.

Consider a configuration in which the cutout portion 34A is formed at the position of the center line CL (center) of the front face panel 34. In such a configuration, load is substantially evenly distributed to the tear sections 36 at either side. Thus a sufficient load to tear the tear sections 36 at both sides at the same time is required while opening. In contrast thereto, in the wrap around case 10 of the present exemplary embodiment, concentrating load at the one tear section 36 enables the tear sections 36 to be torn under a smaller load than in cases in which the tear sections 36 at both sides are torn at the same time.

As illustrated in FIG. 6, opening of the wrap around case 10 is completed by tearing the tear section 36 at the right side and the tear section 36 at the left side. Note that in the wrap around case 10 of the present exemplary embodiment, the top face panel 28 and the back face panel 30 are linked together, and there is no portion that is detached from the case body 12, such that there is no unnecessary waste discharged while opening. An edge at the upper portion of each front face side inner flap 24 is configured by the sloped portion 34B, such that, when the recording tape cartridges 100 are removed in the open state, fingers can be inserted between the front face side inner flap 24 and the back face side inner flap 26 to remove the recording tape cartridges 100. Namely, even in cases in which the recording tape cartridges 100 are stored without any gaps as in the present exemplary embodiment, configuration is such that the recording tape cartridges 100 are easily removed.

After, for example, housing used recording tape cartridges 100, repackaging can be performed by inserting the overlap section 14 inside the front face panel 34. Namely, the wrap around case 10 secures ease of repackaging.

As described above, the wrap around case 10 of the present exemplary embodiment enables ease of opening to be improved, while securing drop resistant ability and repackaging ability.

As illustrated in FIG. 3, in the wrap around case 10 of the present exemplary embodiment, the lower edge portion of the cutout portion 34A is formed in a substantially circular arc shape. This enables the inside of the case body 12 to be better suppressed from being exposed while securing the gap 38 for hooking the hand onto, compared to configurations in which the cutout portion 34A is cut out in a substantially rectangular shape.

Configurations in which load is concentrated at the right side (one) tear section 36 and the tear section 36 is torn, as in the present exemplary embodiment, enable the top face panel 28 to avoid, or be suppressed from, deforming into a peaked shape prior to the tear sections 36 tearing, even when the top face panel 28 has a thin thickness.

Second Exemplary Embodiment

Figure 7:
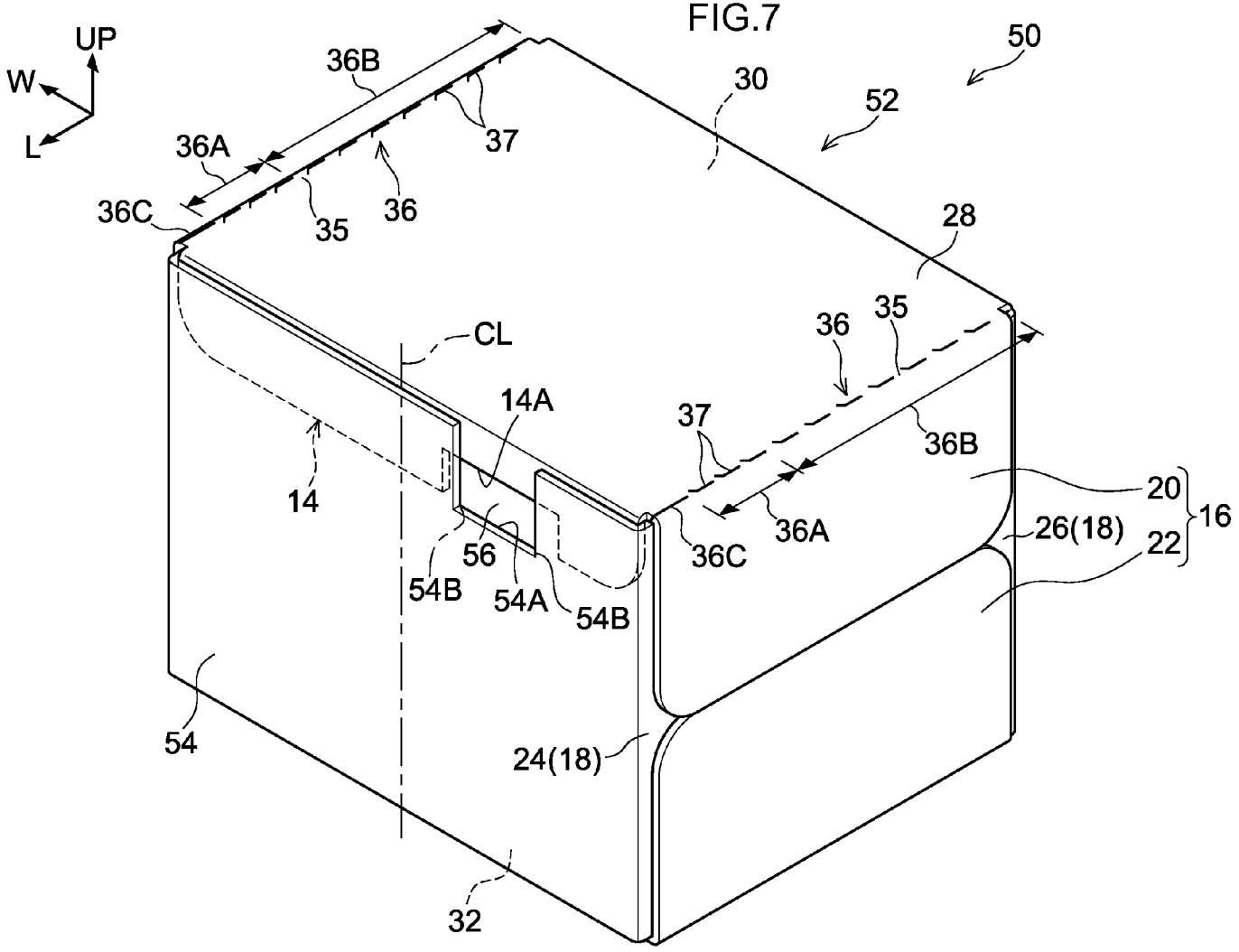
FIG. 7 is a perspective view corresponding to FIG. 1, illustrating a wrap around case according to a second exemplary embodiment.

Explanation follows regarding a wrap around case (wrap-round case) according to a second exemplary embodiment of the present invention, based on FIG. 7. Note that a feature of the wrap around case of the present exemplary embodiment is that the shape of a cutout portion is a substantially rectangular shape. Note that similar configuration to the first exemplary embodiment is appended with the same reference numerals, and explanation thereof is omitted as appropriate.

As illustrated in FIG. 7, a wrap around case 50 of the present exemplary embodiment is configured including a substantially box-shaped case body 52, including the top face panel 28 and the bottom face panel 32 that face each other, a front face panel 54 and the back face panel 30 that face each other, and the pair of side face panels 16 that face each other. Note that a cutout portion 54A, at a position offset to the right side of the center line CL (center) along the width direction (the facing direction of the side face panels 16) of the front face panel 54, is formed to an upper edge portion (an edge portion at the top face panel 28 side) of the front face panel 54.

The cutout portion 54A is formed in a shape cut out in a substantially rectangular shape in front face view from a portion at the upper edge portion of the front face panel 54. The short-height portion 14A is formed to the overlap section 14 at a position that overlaps the cutout portion 54A, and a gap 56 is formed between the cutout portion 54A and the overlap section 14.

The wrap around case 50 of the present exemplary embodiment configured as described above exhibits similar operation and advantageous effects to the wrap around case 10 of the first exemplary embodiment.

Note that in the present exemplary embodiment, the thickness of the front face panel 54 may be made thicker or the like such that the front face panel 54 does not fold about corner portions 54B of the cutout portion 54A when load concentrates at the corner portions 54B. Each corner portion 54B may be formed in a smooth substantially circular arc shape (rounded shape).

Third Exemplary Embodiment

Figure 8:
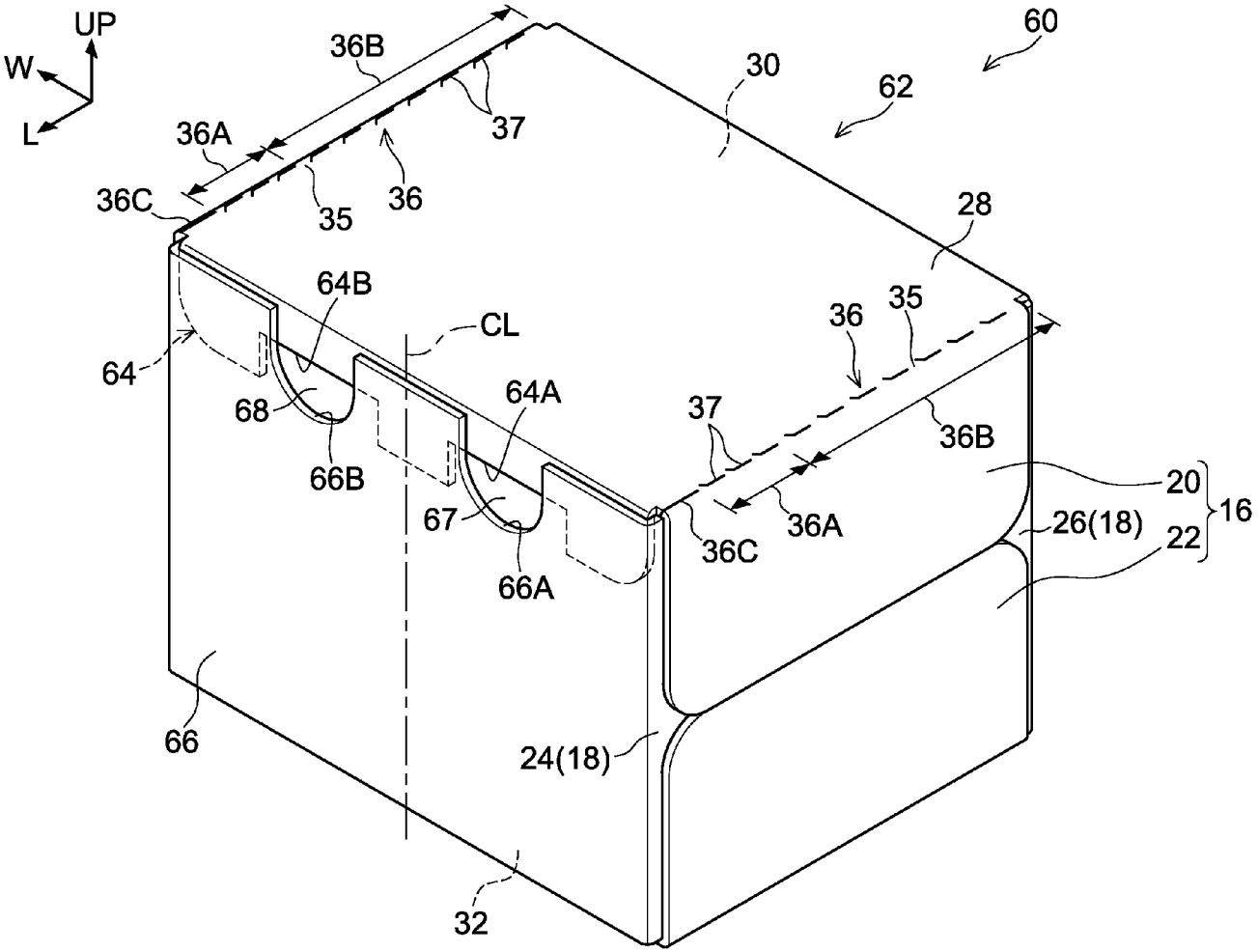
FIG. 8 is a perspective view corresponding to FIG. 1, illustrating a wrap around case according to a third exemplary embodiment.

Explanation follows regarding a wrap around case (wrap-round case) according to a third exemplary embodiment of the present invention, based on FIG. 8. Note that a feature of the wrap around case of the present exemplary embodiment is that plural cutout portions are included. Note that similar configuration to the first exemplary embodiment is appended with the same reference numerals, and explanation thereof is omitted as appropriate.

As illustrated in FIG. 8, a wrap around case 60 of the present exemplary embodiment is configured including a substantially box-shaped case body 62, including the top face panel 28 and the bottom face panel 32 that face each other, a front face panel 66 and the back face panel 30 that face each other, and the pair of side face panels 16 that face each other. Note that a cutout portion 66A and a cutout portion 66B are formed to an upper edge portion (an edge portion at the top face panel 28 side) of the front face panel 66, at either end side thereof with the center line CL (center) along the width direction (the facing direction of the side face panels 16) of the front face panel 66 interposed therebetween.

Similarly to the cutout portion 34A of the first exemplary embodiment, the cutout portion 66A is formed at a position offset to the right side of the center line CL in the width direction of the front face panel 66. In contrast, the cutout portion 66B is formed at a position offset to the left side of the center line CL in the width direction of the front face panel 66. Similarly to in the first exemplary embodiment, the cutout portion 66A and the cutout portion 66B each have a shape of an ellipse with the upper half cut away in front face view.

A short-height portion 64A is formed at a position of an overlap section 64 that overlaps the cutout portion 66A, and a gap 67 is formed between the overlap section 64 and the cutout portion 66A. A short-height portion 64B is formed at a position of the overlap section 64 that overlaps the cutout portion 66B, and a gap 68 is formed between the overlap section 64 and the cutout portion 66B. The short-height portion 64A and the short-height portion 64B each have a similar shape to that in the first exemplary embodiment.

In the wrap around case 60 of the present exemplary embodiment configured as described above, the operator is able to select a cutout portion on which to hook their hand when opening the wrap around case 60. Namely, if the operator is right-handed, their hand can be hooked on the gap 67 between the cutout portion 66A and the overlap section 64 at the right side, and if the operator is left-handed, their hand can be hooked on the gap 68 between the cutout portion 66B and the overlap section 64 at the left side, to open the wrap around case 60. Other operation and advantageous effects are similar to those in the first exemplary embodiment.

Note that there is no particular limitation to the position of the cutout portion 66A, as long as the position is offset to the right side of the center line CL in the width direction of the front face panel 66. There is also no particular limitation to the position of the cutout portion 66B, as long as the position is offset to the left side of the center line CL in the width direction of the front face panel 66. There is also no particular limitation to the size or shape of each cutout portion, and, for example, some of the cutout portions may be formed in a substantially rectangular shape in front face view. The cutout portions may be made smaller in size, or the number of cutout portions may be increased. For example, two or more cutout portions may be formed at positions offset to the right side of the center line CL in the width direction of the front face panel 66.

Fourth Exemplary Embodiment

Figure 9:
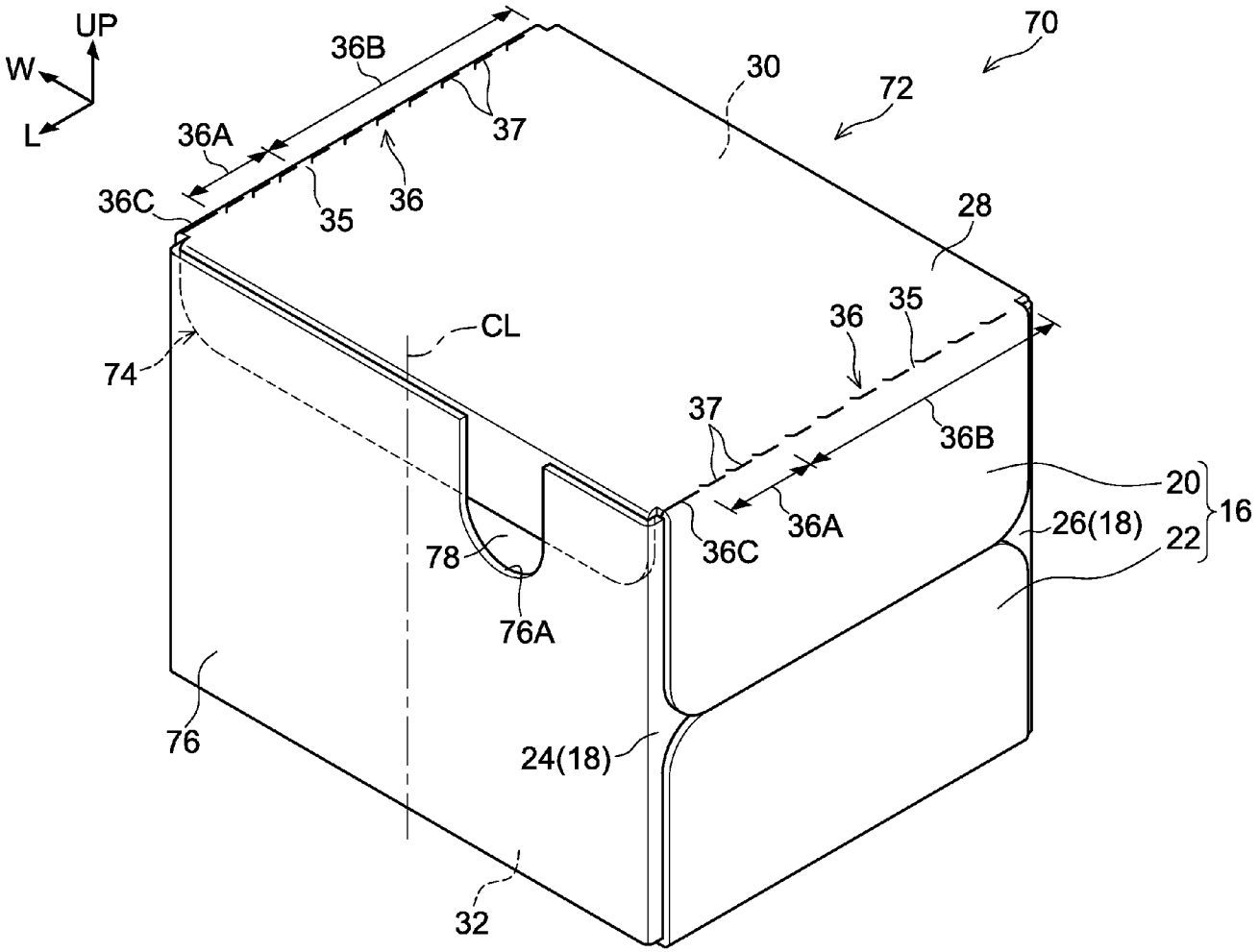
FIG. 9 is a perspective view corresponding to FIG. 1, illustrating a wrap around case according to a fourth exemplary embodiment.

Explanation follows regarding a wrap around case (wrap-round case) according to a fourth exemplary embodiment of the present invention, based on FIG. 9. Note that a feature of the wrap around case of the present exemplary embodiment is that a cutout portion of a front face panel is deeper than an overlap section, without forming a short-height portion to the overlap section. Note that similar configuration to the first exemplary embodiment is appended with the same reference numerals, and explanation thereof is omitted as appropriate.

As illustrated in FIG. 9, a wrap around case 70 of the present exemplary embodiment is configured including a substantially box-shaped case body 72, including the top face panel 28 and the bottom face panel 32 that face each other, a front face panel 76 and the back face panel 30 that face each other, and the pair of side face panels 16 that face each other. Note that a cutout portion 76A, in a position offset to the right side of the center line CL along the width direction (the facing direction of the side face panels 16) of the front face panel 76, is formed to an upper edge portion (an edge portion at the top face panel 28 side) of the front face panel 76.

The cutout portion 76A is formed in a similar position to the cutout portion 34A of the first exemplary embodiment, and has the shape of an ellipse with the upper half cut away in front face view. The cutout portion 76A is cut out extending further downward than the cutout portion 34A of the first exemplary embodiment, and is cut out extending further downward than a lower end portion of an overlap section 74 in the present exemplary embodiment.

The overlap section 74 formed with a constant length in the up-down direction (height), excluding locations at both end portions at which the corners are rounded, and a short-height portion is not formed at the position of the overlap section 74 that overlaps the cutout portion 76A. A gap 78 is formed between the overlap section 74 and the cutout portion 76A.

The wrap around case 70 of the present exemplary embodiment configured as described above enables the gap 78 through which the operator inserts their hand during opening to be formed without forming a short-height portion in the overlap section 74. Other operation and advantageous effects are similar to those in the first exemplary embodiment.

Other Modified Examples

Wrap around cases according to the first exemplary embodiment to the fourth exemplary embodiment have been explained above. However, the present invention is not limited to the above exemplary embodiments, and various modifications are possible within a range not departing from the spirit thereof. For example, in FIG. 3, the cutout portion 34A is formed at a position offset to the right side of the center line CL in the width direction of the front face panel 34; however, configuration is not limited thereto, and a cutout portion may be formed at a position offset to the left side of the center line CL.

The overlap section 14 is inserted inside the front face panel 34 in the sealed state; however, the present invention is not limited thereto. For example, the overlap section 14 may be adhered (joined) to the outside of the front face panel 34 by adhesive, etc. In such cases, for example, opening may be performed by peeling the overlap section 14 away from the front face panel 34, and then gripping the overlap section 14 and pulling the top face panel upward. After opening, repackaging may be performed by inserting the overlap section 14 inside the front face panel 34.

As illustrated in FIG. 4, in the above exemplary embodiments, each narrow pitch portion 36A is configured from the back face side end portion of the end portion incision portion 36C as far as the third incision portion; however, the present invention is not limited thereto. For example, the narrow pitch portion 36A may be configured from the back face side end portion of the end portion incision portion 36C as far as the first incision portion. Conversely, the narrow pitch portion 36A may be formed extending further to the back face side than the fourth incision portion, and the narrow pitch portion 36A may configure half or more of the range of the ridgeline 35 between the top face panel 28 and the side face panel 16. The narrow pitch portion 36A may be configured formed as far as a front face side end portion, without forming the end portion incision portion 36C.

It is preferable to form the narrow pitch portion 36A to the tear section 36 at either width direction side of the top face panel 28; however, the present invention is not limited thereto. For example, a configuration may be applied in which the narrow pitch portion 36A is only formed to the tear section 36 nearest to the cutout portion 34A. Even in such cases, the narrow pitch portion 36A is formed to the tear section 36 that is first torn while opening, thereby enabling a reduction in the ease of opening to be suppressed.

Figure 10:
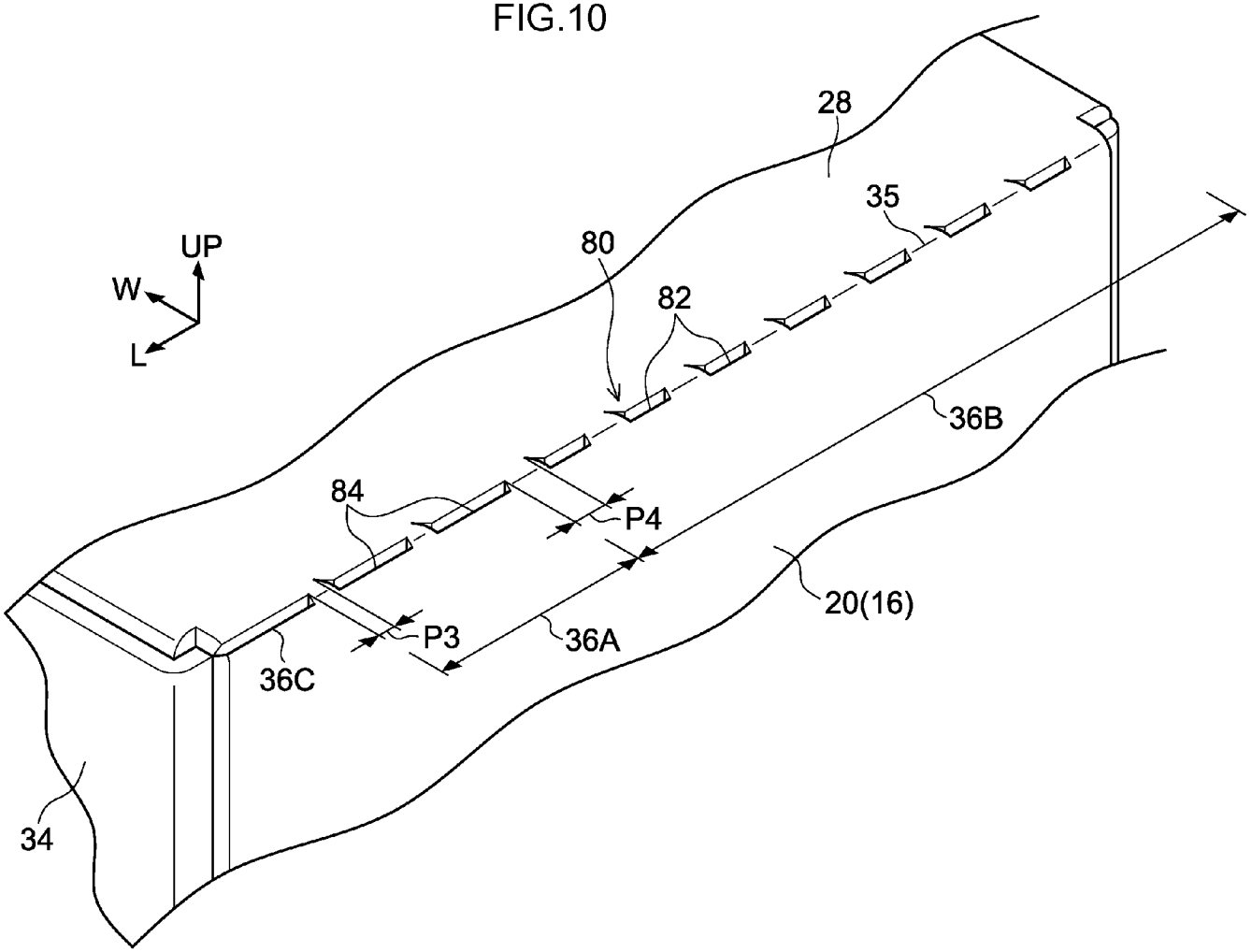
FIG. 10 is a perspective view corresponding to FIG. 4, illustrating a wrap around case according to a modified example.

In the above exemplary embodiments, each narrow pitch portion 36A is formed to the front face side of the top face panel 28, such that the strength of the tear section 36 at the front face side is weaker than the strength of the tear section 36 at the back face side however, the present invention is not limited thereto. For example, as illustrated in a tear section 80 in FIG. 10, incision portions 82 and incision portions 84 configuring the tear section 80 may each be set at the same pitch, and the incision portions 84 at the front face side of the tear section 36 may each have a longer incision length than the incision portions 82 at the back face side. Even in such cases, a length P3 of each portion linking between adjacent incision portions 84 is shorter than a length P4 of each portion linking between adjacent incision portions 82, thereby enabling a weaker strength to be set at the front face side of the tear section 80 than at the back face side. Namely, ease of opening can be improved. In the configuration in FIG. 10, the incision portions 84 may each be set with a narrower pitch than the incision portions 82.

What is claimed is:

1. A wrap around case comprising:

a case body that comprises a top face panel and a bottom face panel facing each other, a front face panel and a back face panel facing each other, and a pair of side face panels facing each other, the case body being formed with a perforated tear section running along a ridgeline formed by the top face panel and each of the pair of side face panels; and an overlap section that extends from the top face panel toward a bottom face panel and overlaps the front face panel, and a gap being formed between the overlap section and a cutout portion formed at a position offset to one end side or another end side of a center, along a facing direction of the side face panels, of an edge portion of the front face panel, that is nearer to the top panel than to the bottom panel.

2. The wrap around case of claim 1, wherein:

the overlap section overlaps a face of the front face panel at a side facing the back face panel; and a portion of the overlap section exposed through the cutout portion is formed with a shorter length from the top face panel than other portions of the overlap section.

3. The wrap around case of claim 1, wherein at least the tear section at the side to which the cutout portion is offset is formed with a weaker strength at a position nearer to the front face panel than a position nearer to the back face panel.

4. The wrap around case of claim 3, wherein:

each tear section is configured including a plurality of incision portions arrayed along each ridgeline; and the incision portions are formed such that a pitch of the incision portions is narrower at a position nearer to the front face panel than a position nearer to the back face panel.

5. The wrap around case of claim 3, wherein:

each tear section is configured including a plurality of incision portions arrayed along each ridgeline; and the incision portions are formed with a longer length along each ridgeline at a position nearer to the front face panel than a position nearer to the back face panel.

6. The wrap around case of claim 1, wherein the cutout portion is formed at both the one end side and the other end side of the center, along the facing direction of the side face panels, of the front face panel.

7. The wrap around case of claim 1, wherein the edge portion, that is nearer to the bottom face panel, of the cutout portion is formed in a circular arc shape.

8. The wrap around case of claim 1, wherein the wrap around case is for storing a plurality of recording tape cartridges.

* * * * *